United States Patent [19]

Eckles et al.

[11] 4,139,425

[45] Feb. 13, 1979

[54] COMPOSITION, PLATING BATH, AND METHOD FOR ELECTROPLATING TIN AND/OR LEAD

[75] Inventors: William E. Eckles, Cleveland Heights; William J. Willis, North Royalton, both of Ohio

[73] Assignee: R. O. Hull & Company, Inc., Cleveland, Ohio

[21] Appl. No.: 893,618

[22] Filed: Apr. 5, 1978

[51] Int. Cl.[2] ..... C25D 3/32; C25D 3/36; C25D 3/60; C07D 207/00

[52] U.S. Cl. ..... 204/43 S; 204/53; 204/54 R; 204/DIG. 2; 544/406; 544/410; 548/335; 548/341; 548/343

[58] Field of Search ..... 548/335, 341, 343; 260/295 R, 295.5 R; 544/406, 410; 204/43 S, 53, 54 R, DIG. 2

[56] References Cited

U.S. PATENT DOCUMENTS

| | | | |
|---|---|---|---|
| 3,361,652 | 1/1968 | Korpiun et al. | 204/54 R |
| 3,850,765 | 11/1974 | Karustis et al. | 204/43 S |

*Primary Examiner*—G. L. Kaplan

*Attorney, Agent, or Firm*—Maky, Renner, Otto & Boisselle

[57] ABSTRACT

A composition is described which is useful particularly in improving the electrodeposition of tin, lead or tin-lead from an aqueous acidic plating bath. The new composition comprises a reaction product of an unsaturated nitrogen-containing heterocyclic compound with a mixture comprising formaldehyde and an unsaturated aliphatic aldehyde containing up to about six carbon atoms. Aqueous acidic plating baths containing the additive compositions of the invention, and methods for depositing tin, lead or tin-lead alloys from such baths as well as additive compositions for forming the baths also are described.

31 Claims, No Drawings

COMPOSITION, PLATING BATH, AND METHOD FOR ELECTROPLATING TIN AND/OR LEAD

BACKGROUND OF THE INVENTION

This invention relates to the electrodeposition of tin, lead, and tin-lead alloys, and particularly to new compositions which are useful as additives in a plating bath for depositing smooth, level and bright tin and/or lead coatings.

Aqueous acidic plating baths for depositing tin and/or lead coatings have been known in the art, and most of these baths contain, in addition to the water-soluble tin and/or lead salts, at least one radical selected from the group consisting of fluoborates, fluosilicates, sulfates, sulfamates, etc. In addition to these basic ingredients, the prior art has suggested improvements in such baths by including additives which will improve the brightness of the deposit obtained from such baths. In U.S. Pat. No. 3,875,029, the use of a naphthalene monocarboxaldehyde either alone or in combination with certain substituted olefins described in the patent results in an improvement in the brightness of the deposit. Other ingredients which have been suggested as being useful additives in tin and/or lead plating baths include various combinations of aldehydes, ketones, nonionic surfactants, and amines. For example, U.S. Pat. No. 3,769,182 describes the advantage of utilizing an alkoxylated fatty acid alkylolamide surfactant in tin and/or lead plating baths, and U.S. Pat. No. 3,749,649 describes the advantages of utilizing tin-lead plating baths containing at least one polyether surfactant and at least one aromatic aldehyde containing a chloro substituent. Another bath for producing bright deposits of tin-lead alloys is described in U.S. 3,785,939 and the U.S. Pat. No. system comprises a combination of a nonionic polyoxyalkylated surfactant, a lower aliphatic aldehyde, an aromatic aldehyde, and an amine. U.S. Pat. No. 4,000,047 describes a bath for depositing tin and tin-lead alloys which contain a lower alkylene oxide condensation product selected pyridine and quinoline compounds and aromatic aldehydes.

SUMMARY OF THE INVENTION

It now has been found that a smooth, level and bright deposit of tin, lead or tin-lead alloy can be deposited on a substrate from an aqueous acid plating bath comprising at least one metal salt selected from the group consisting of a stannous salt, a lead salt, or a mixture of stannous and lead salts, and as a brightener agent an effective amount of at least one composition comprising the reaction product of an unsaturated nitrogen-containing heterocyclic compound with a mixture comprising formaldehyde and an unsaturated aliphatic aldehyde containing up to about six carbon atoms. In a preferred embodiment, the mixture reacted with the heterocyclic compound also contains an aliphatic carboxylic acid containing up to about five carbon atoms.

In addition to the above described compositions of the invention, the aqueous acid plating bath of the invention also may contain at least one radical selected from the group consisting of fluoborates, fluosilicates, sulfates, sulfamates, or mixtures thereof, aliphatic and/or aromatic aldehydes and aromatic amines. When the above-described brightener compositions are utilized in the above-described plating baths, the tin and/or lead deposited from said baths is smooth and bright.

DESCRIPTION OF THE PREFERRED EMBODIMENTS

The compositions of the invention which are useful particularly as brightener additive compositions for aqueous acidic tin, lead, or tin-lead plating baths are reaction products of an unsaturated nitrogen-containing heterocyclic compound with a mixture of formaldehyde, an unsaturated aliphatic aldehyde containing up to about six carbon atoms, and, optionally, an aliphatic carboxylic acid containing up to about five carbon atoms.

Generally, the nitrogen-containing heterocyclic compound is dissolved in water, the solution is warmed to between about 50–100° C. whereupon the formaldehyde is added and the resulting solution heated at the reflux temperature for about 0.5 to one hour or more. While maintaining the refluxing conditions, the aliphatic acid is added followed by the dropwise addition of the unsaturated aldehyde. After all of the aldehyde has been added, the reaction mixture is refluxed for an additional 0.5 to two hours to ensure completion of the reaction. On cooling, the reaction product is ready for use or may be diluted further as desired.

The unsaturated nitrogen-containing heterocyclic compounds which are useful in the preparation of the compositions of the invention preferably are imidazoles, pyrazoles, pyrazines or pyridines which may be substituted or unsubstituted.

The imidazoles which are useful in the invention generally will have the formula

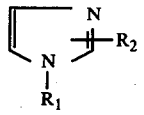

wherein $R_1$ is hydrogen, alkyl, acyl, vinyl, amino acid, or a 1-carbonyl imidazole group, and $R_2$ is hydrogen, alkyl, or an aryl group. Examples of such imidazoles include: imidazole, 1-vinyl imidazole, 1,2-dimethyl imidazole, histidine, 4-phenyl imidazole, 1-methyl imidazole, 1-ethyl imidazole, 2-methyl imidazole, 1-acetyl imidazole and 1,1'-carbonyldiimidazole.

The pyrazole compounds which are useful in the invention have the general formula

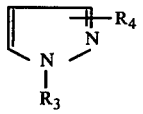

wherein $R_3$ is hydrogen or an alkyl group and $R_4$ is hydrogen or an alkyl or one or more carboxyl groups. Examples of such pyrazoles include: pyrazole, 3-methyl pyrazole and 3,5-pyrazole dicarboxylic acid.

The pyridine compounds which are useful have the general formula

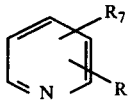

wherein R and $R_7$ are each independently hydrogen, alkyl, aminoalkyl, hydroxyalkyl, carboxyalkyl, or carboxyl groups. Examples of such pyridines include: pyridine, 3-picoline, 4-picoline, 3-picolyl amine, 4-pycolyl amine, 2,6-pyridine dimethanol, 2-pyridineethanol, 2-pyridine carboxaldehyde, 2-pyridylacetic acid, 4-pyridine carboxaldehyde, 3-pyridine carboxylic acid (nicotinic acid), 3,5-pyridine dicarboxylic acid, the corresponding 2,3-, 2,4-, 2,5-, 2,6- and 3,4-dicarboxylic acids.

The pyrazine compounds which are useful have the general formula

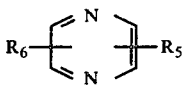

wherein $R_5$ and $R_6$ are each independently hydrogen, alkyl, aminoalkyl, hydroxyalkyl, carboxyalkyl, carboxy or amide groups. Specific examples of such pyrazines include: pyrazine, pyrazineamide, 2,5-dimethyl pyrazine, 2-pyrazine carboxylic acid, 2,3-pyrazinedicarboxamide and 2,3-pyrazinedicarboxylic acid.

Since the compositions of the invention generally are prepared in water, the formaldehyde used to form the composition generally is an aqueous solution such as, for example, an aqueous solution containing 37% formaldehyde which is available commercially as Formalin. Formaldehyde generators such as paraformaldehyde, trioxane, etc. may be utilized in the process as a source of formaldehyde.

The unsaturated aliphatic aldehydes which are useful in the invention will contain up to about six carbon atoms. Examples of such unsaturated aliphatic aldehydes include acrolein, crotonaldehyde and 2-hexenal.

An aliphatic carboxylic acid containing up to about five carbon atoms also may be included in the reaction mixture. Examples of useful acids include formic, acetic, propionic, butyric and pentanoic acids. Formic and acetic acids are preferred examples.

The relative amounts of the materials which are reacted to form the compositions of the invention may vary, and generally, the mixture will comprise a mole ratio of heterocyclic amine, formaldehyde, unsaturated aliphatic aldehyde and carboxylic acid of from about 1:1:0.5:0 to about 1:4:2:4 and is preferably about 1:1:0.5:0.5 to about 1:4:2:4. Although it has been indicated that the presence of the aliphatic carboxylic acid is optional, it is preferred to use an aliphatic carboxylic acid in the formation of the reaction product and, accordingly, a preferred ratio of heterocyclic amine, formaldehyde, carboxylic acid, and aldehyde is about 1:2:1:1.

The following examples illustrate the preparation of the compositons of the invention which are particularly useful as brightener additives in tin, lead, and tin-lead baths. Unless otherwise indicated, all parts and percentages are by weight.

EXAMPLE 1

Imidazole (3.4 grams, 0.05 mole) is dissolved in 50 cc. of water, and the solution is stirred and warmed to about 70° C. Formalin (8.3 ml., 0.2 mole) is then added dropwise and the resulting solution heated at the reflux temperature for about 45 minutes. Glacial acetic acid (3 cc., 0.05 mole) is added slowly to the refluxing mixture followed by the dropwise addition of 2.8 grams (0.04 mole) of crotonaldehyde. The reaction mixture is heated at reflux for an additional 1.5 hours. Upon cooling, the reaction mixture is ready for use or may be diluted further.

EXAMPLE 2

Pyrazinamide (3.1 grams) is stirred with 25 ml. of water and the mixture is heated to about 80° C. whereupon 4.2 ml. of Formalin ia added dropwise. This mixture is heated at reflux for 30 minutes followed by the addition of 1.2 ml. of formic acid. After all of the acid is added, 1.4 grams of crotonaldehyde is added dropwise while maintaining the mixture at the reflux temperature. Refluxing of the mixture is continued for one hour and the mixture is allowed to cool.

EXAMPLE 3

To 50 cc. of water is added 5.4 grams of 3-pycolyl amine, and the mixture is heated to about 70° C. whereupon 8.3 cc. of Formalin is added dropwise. After this mixture is heated and maintained at the reflux temperature for about 40 minutes, 3 cc. of glacial acetic acid is added followed by dropwise addition of 2.8 grams of crotonaldehyde. The mixture is maintained at the reflux temperature for an additional 1.5 hours.

EXAMPLE 4

A solution of 4.7 grams of 1-vinyl imidazole in 60 cc. of water is prepared and warmed to about 60° C. whereupon 8.3 cc. of Formalin is added dropwise. After heating the mixture at the reflux temperature for about 30 minutes, 3 cc. of glacial acetic acid is added followed by dropwise additon of 4.2 grams of crotonaldehyde. This mixture is maintained at the reflux temperature for an additional one hour.

EXAMPLE 5

A solution of 3.4 grams of pyrazole in 50 cc. of water is prepared and the solution is stirred and heated to about 70° C. whereupon 8.3 cc. of Formalin is added dropwise. This mixture is heated to the reflux temperature and maintained at this temperature for about 45 minutes whereupon 3 cc. of glacial acetic acid is added dropwise followed by the dropwise addition of 2.2 grams of acrolein. This reaction mixture is refluxed an additional 1.5 hours.

EXAMPLE 6

A solution of 4.7 grams of 4-picoline in 50 cc. of water is prepared and heated to about 70° C. whereupon 8.3 cc. of Formalin is added dropwise. The mixture is refluxed for 40 minutes whereupon 3. cc. of glacial acetic acid is added followed by the dropwise addition of 2.8 grams of crotonaldehyde. The mixture is heated at the reflux temperature for an additional 1.5 hours.

EXAMPLE 7

The procedure of Example 1 is repeated except that the acetic acid is omitted from the reaction mixture.

EXAMPLE 8

The procedure of Example 1 is repeated except that the imidazole is replaced by an equivalent amount of histidine.

EXAMPLE 9

The procedure of Example 1 is repeated except that the imidazole is replaced by an equivalent amount of 3-pyridine carboxylic acid(nicotinic acid).

As mentioned above, the compositions of the invention such as those described in the above examples are useful particularly as brightening additives for otherwise conventional aqueous acidic tin, lead, or tin-lead plating baths over a wide range of current densities. Such baths contain water-soluble stannous salts, water-soluble lead salts, or mixtures thereof, depending upon the metal or metals to be deposited by the bath on a substrate, and a radical selected from the group consisting of fluoborates, fluosilicates, sulfates, sulfamates and mixtures thereof. The amount of metal ion or ions in the bath may vary over a wide range depending upon the desired properties of the plating to be deposited on the substrate. Generally, from about five to about 350 grams per liter or more of the metal ion or ions, and from about 50 to about 500 grams per liter of the above-defined radicals will be included in the plating baths of the invention. Obviously, when a tin deposit is desired, the lead ion should be omitted from the bath, and, conversely, when a lead deposit is desired, the stannous ion is omitted from the bath. The aqueous acid plating baths of the invention generally are maintained at a pH of less than about three.

The aqueous acid plating baths of the invention may be utilized to produce tin, lead, or tin-lead deposits on all types of metals and alloys, for example, on iron, copper and brass, and the brightener agents described above may be added to such plating baths employed in all types of industrial plating processes including still plating baths, high-speed plating baths for strip or wire plating, and in barrel plating.

The amount of the above-described brightener compositions which is added to the acid plating baths of the invention is an amount which is sufficient to produce a smooth and bright tin, lead, or tin-lead deposit on the substrate, and generally in a range from about one to about 50 grams per liter and preferably from about one to about 30 grams per liter of bath.

The properties of the tin and/or lead deposited by the baths of the invention may be enhanced further by including other additives in the bath. The brightness of the deposit generally is improved if the bath contains at least one carbonyl compound (aldehyde and/or ketone). Thus, the plating baths of the invention may contain at least one aldehyde which may be an aliphatic aldehyde, an aromatic aldehyde, or mixtures of such aldehydes. The aliphatic aldehydes which are particularly useful in the plating baths of the invention are those containing up to about four carbon atoms and these include, for example, formaldehyde, acetaldehyde, propionaldehyde, butyraldehyde, crotonaldehyde, and 3-hyroxy-butanal. Up to about 25 grams per liter of the aliphatic aldehyde may be included in the baths and preferably, from about one to about 25 grams per liter of the aliphatic aldehyde is utilized.

Preferred examples of the aromatic aldehydes which have been found useful are the naphthaldehydes and benzaldehydes. it is preferred that the benzaldehydes contain at least one chloro substituent. Examples of aromatic aldehydes which may be utilized in the plating baths of the invention include o-chlorobenzaldehyde; 2,4-dichlorobenzaldehyde; 3,4-dichlorobenzaldehyde, 3,5-dichlorobenzaldehyde; 2,6-dichlorobenzaldehyde; tolualdehyde; 3,4-dimethoxybenzaldehyde; cinnamaldehyde; and anisaldehyde. Examples of the naphaldehydes include 1-naphthaldehyde; 2-naphthaldehyde; 2-methoxy-1-naphthaldehyde; 2-hydroxy-1-naphthaldehyde; 2-ethoxy-1-naphthaldehyde; 4-methoxy-1-naphthaldehyde; 4-ethoxy-1-naphthaldehyde; and 4-hydroxy-1-naphthaldehyde. In some applications, a combination of the naphthaldehyde with a benzaldehyde such as 1-naphthaldehyde with 2,6-dichlorobenzaldehyde provides a superior deposit on the substrates. Examples of other carbonyl compounds include ketones which may include aliphatic ketones such as acetone and methyl ethyl ketone, and aromatic ketones such as benzylidene acetone, coumarin, acetophenone, propiophenone, 3-methoxybenzol acetone. Other carbonyl compounds include furfurylidine acetone, 3-indole carboxyaldehyde and thiophene carboxyaldehyde. The amount of aromatic aldehyde or other carbonyl containing compound included in the baths of the invention will range up to about ten grams per liter of bath and preferably is from about 0.05 to about ten grams per liter of bath.

Mixtures of aliphatic aldehydes and the above-described aromatic aldehydes, and mixtures of naphthaldehydes and benzaldehydes have been found to be particularly useful. Examples of suitable combinations include: the mixture of acetaldehyde and 4-methoxy-1-naphthaldehyde; the mixture of formaldehyde, 1-naphthaldehyde, and 2,6-dichlorobenzaldehyde; etc.

The properties of the tin and/or lead deposits obtained from the baths of the invention also may be improved in some instances by the inclusion of an aromatic amine in the bath, and the bath may contain up to about 15 grams of aromatic amine per liter of bath and generally will contain from about one to about 15 grams of aromatic amine per liter of bath. Examples of aromatic amines which are useful include aniline; o-toluidine; p-toluidine; m-toluidine; and o-chloroaniline.

The baths of the invention also may contain a small amount of one or more chlorinated benzenes such as 1,2-dichlorobenzene; 1,2,4-trichlorobenzene; 1,2,3-trichlorobenzene and 1,3,5-trichlorobenzene. Amounts up to about five grams of the chlorinated benzene per liter of bath, and preferably from about 0.5 to about three grams per liter, may be utilized.

The incorporation of one or more other wetting or surface active agents into the additive composition and plating baths of the invention results in a tin and/or lead plating with improved leveling and brightness, and the additive composition and plating baths exhibit improved stability.

Wetting agents based on ethylene and propylene oxide, for example, polyglycol compounds and the like, and sulfonated wetting agents also are useful at levels of about 1 to 25 g/l and preferably at about 3-5 g/l of bath. In general, the nonionic wetting agents such as those containing ether linkages are particularly useful additives. Examples of such ether-containing wetting agents are those having the general formula $$R_8—O—[(CH_2)_nO]_xH$$

wherein $R_8$ is an aryl or alkyl group containing from about 6 to 20 carbon atoms, n is two or three, and x is an integer between 2 and 100 . Such wetting agents are produced generally by treating fatty alcohols or alkyl-substituted phenols with excess ethylene oxide or propylene oxide. The alkyl carbon chain may contain from about 14 to 24 carbon atoms and may be derived from a long chain fatty alcohol such as oleyl alcohol or stearyl alcohol.

Nonionic polyoxyethylene compounds of this type are described in U.S. Pat. No. 3,855,085. Such polyoxyethylene compounds are available commercially under the general trade designations "Surfynol" by Air Products and Chemicals, Inc. of Wayne, Pennsylvania, and under the designation "Pluronic" or "Tetronic" by BASF Wyandotte Corp. of Wyandotte, Mich. Examples of specific polyoxyethylene condensation products useful in the invention include "Surfynol 465" which is a product obtained by reacting about 10 moles of ethylene oxide with 1 mole of tetramethyldecynediol. "Surfynol 485" is the product obtained by reacting 30 moles of ethylene oxide with tetramethyldecynediol. "Pluronic L 35" is a product obtained by reacting 22 moles of ethylene oxide with polypropylene glycol obtained by the condensation of 16 moles of propylene oxide.

Amine, long chain fatty amine, long chain fatty acid, alkanol amines, diamines, amides, alkanol amides and polyglycol-type wetting agents known in the art are also useful. One type of amine wetting agent found particularly useful in a tin or lead plating bath is the group obtained by the addition of a mixture of proplyene oxide and ethylene oxide to diamines. More specifically, compounds formed by the addition of propylene oxide to ethylene diamine followed by the addition of ethylene oxide are useful and are available commercially from BASF Wyandotte Ind. Chemical Group under the general trade designation "Tetronic".

Carbowax-type wetting agents which are polyethylene glycols having different molecular weights ave been found to give good results. For example Carbowax No. 1000 has a molecular weight range of from about 950 to 1,050 and contains from 20 to 24 ethoxy units per molecule. Carbowax No. 4000 has a molecular weight range of from about 3000 to 3700 and contains from 68 to 85 ethoxy units per molecule. Other known nonionic glycol derivatives such as polyalkylene glycol ethers and methoxy polyethylene glycols which are available commercially can be utilized as wetting agents in the compositions of the invention.

Other alkoxylated amines which may be utilized as supplemental brighteners in the baths of the invention are represented by the formulas I and II

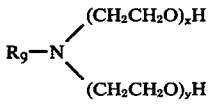

I

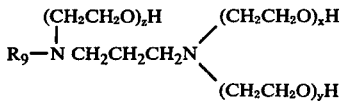

II wherein $R_9$ is a fatty amine alkyl group containing from 12 to 18 carbon atoms, and x, y and z are each independently integers from 1 to about 30, and the sum of x, y and z is an integer of from 3 to about 50.

The above described alkoxylated amines are known in the art and are available from a variety of commercial sources. The amines of the type represented by formula I can be prepared by condensing various amounts of ethylene oxide with primary fatty amines which may be a sngle amine or a mixture of amines such as are obtained by the hydrolysis of tallow oils, sperm oils, coconut oils, etc. Specific examples of fatty amines containing from eight to 22 carbon atoms include saturated as well as unsaturated aliphatic amines such as octyl amine, decyl amine, lauryl amine, stearyl amine, oleyl amine, myristyl amine, palmityl amine, dodecyl amine, and octadecyl amine.

The above described amines can be prepared, as mentioned above, by condensing alkylene oxides with the above-described primary amines by techniques known to those in the art. A number of such alkoxylated amines is commercially available from a variety of sources. The alkoxylated amines of the type represented by formula I are available from the Armak Chemical Division of Akzona, Inc., Chicago, Ill. under the general trade designation "Ethomeen". Specific examples of such products include "Ethomeen C/15" which is an ethylene oxide condensate of a coconut fatty amine containing about 5 moles of ethylene oxide; "Ethomeen C/20" and "C/25" which also are ethylene oxide condensation products from coconut fatty amine containing about 10 and 15 moles of ethylene oxide respectively; "Ethomeen S/15" and "S/20" which are ethylene oxide condensation products with stearyl amine containing about 5 and 10 moles of ethylene oxide per mole of amine respectively; and "Ethomeen T/15" and "T/25" which are ethylene oxide condensation products of tallow amine containing about 5 and 15 moles of ethylene oxide per mole of amine respectively. Commercially available examples of the alkoxylated amines of the type represented by formula II include "Ethoduomeen I/13" and "T/20" which are ethylene oxide condensation products of N-tallow trimethylene diamine containing about 3 and 10 moles of ethylene oxide per mole of diamine respectively.

In some of the baths, improved results are obtained when polyoxyalkylated glycols, phenols and/or naphthols are included. For example ethylene oxide and propylene oxide condensates with aliphatic alcohols, sorbitan alkyl esters, alkyl phenols and naphthols are useful aditives. About 6 to about 40 moles of the oxide may be condensed with the above identified compounds. Many of these condensates are available commercially under such trade names as "Tween" from ICI America, "Triton" from Rohm & Haas Co., "Tergitol" from Union Carbide, and "Igepal" from General Aniline and Film Corp.

The acid tin, lead, and tin-lead plating baths of the present invention deposit a level coating of the metal or alloy on substrates at any conventional temperatures used with tin and/or lead plating baths, and over a wide current density range such as from two to 2000 amperes per square foot (ASF).

The following examples illustrate the plating baths of the invention containing the compositions of the invention. Unless indicated, all parts and percentages are by weight. The utility of the baths is demonstrated by plating steel Hull panels in a 267ml. Hull cell. Current densities are measured with a Hull cell scale, and the solutions are agitated mechanically.

EXAMPLE A

An aqueous plating bath is prepared by mixing with water, sufficient quantities of stannous and lead fluoborate, fluoboric acid and boric acid to provide about 10 g/l of stannous tin, about 4.5 g/l of lead ion, about 120 g/l free fluoboric acid and about 15 g/l of boric acid. To this bath is added a brightener system comprising about 4 g/l of Surfonic N-150 (an alkylaryl polyethylene glycol ether available from Jefferson Chemical Comany, Inc.), about 1 g/l acetaldehyde, about 0.1 g/l of 4-methoxy-1-naphthaldehyde and about 8 ml/l of the aqueous reaction product prepared in Example 1. The pH of the bath is less than 1. Plating is effected with this bath in a Hull cell at room temperature using as the anode, an alloy of 60/40 tin/lead. The bright plating current density range is found to extend from about 4 to more than 100 ASF.

EXAMPLE B

An aqueous plating bath is prepared by mixing with water, sufficient quantities of stannous sulfate and sulfuric acid to provide about 15 g/l of stannous ion and 20 g/l of sulfuric acid. To this bath there is added 0.07 g/l of 2-naphthaldehyde and 20 ml/l of the reaction product of Example 4. When a plating test is run in a Hull cell using a pure tin anode and the steel cathode is electrolyzed at 2 amps for 5 minutes, the resulting panel is bright from about 12 to over 80 ASF. When the same test is conducted on a similar bath except that the product of Example 4 is omitted, the deposit which is obtained is dark gray and spongy with no brightness.

EXAMPLE C

An aqueous plating bath is prepared by mixing water with sufficient quantities of stannous and lead fluoborate, fluoboric acid and boric acid to provide about 50 g/l of stannous ion, about 25 g/l of lead ion, about 140 g/l free fluoboric acid and about 30 g/l of boric acid. The bath also contains about 15 g/l of Ethomeen O-15 (an ethylene oxide condensation product containing about 10 moles of ethylene oxide per mole of oleyl amine), 30 ml/l of Formalin, about 1.5 g/l of o-chloroaniline, about 0.2 g/l of 1,2-dichlorobenzene, about 0.2 g/l of 4-methoxynaphthaldehyde and about 8 ml/l of the reaction product prepared in Example 2. A 2 amp Hull cell test panel is electrolyzed for 5 minutes using a 60/40 tin/lead anode. The panel is very bright from about 10 to over 80 ASF. Below about 10 ASF the deposit is a milky white color.

EXAMPLE D

A bath is prepared which is similar to the bath described in Example A except that 8 ml/l of the reaction product of Example 7 is used in place of the reaction product of Example 1. A plating test shows identical results as obtained in Example A with the exception of a slightly duller plate in the lower current densities (less than about 4 ASF.)

Example E

An aqueous plating bath is prepared by mixing water with sufficient quantities of stannous sulfate and sulfuric acid to provide about 20 g/l of stannous ion and 200 g/l of sulfuric acid. To this bath there is added 2 ml/l of the reaction product of Example 5, about 0.1 g/l of 1-naphthalene carboxaldehyde, about 0.4 g/l of acrylic acid and about 10 g/l of Tergitol TMN (a trimethyl nonyl polyethylene glycol ether available from Union Carbide Corp.) A plating test is conducted with this bath using a conventional Hull cell steel cathode panel and tin electrode. A current of 2 amps is used for 5 minutes at room temperature with mechanical agitation of the electrolyte. The resulting plated panel is full bright from about 8 to well over 80 ASF. The deposit below 8 ASF is a whitish color.

In practice, the improved tin, lead and tin-lead alloy plating baths containing the brightener compositions of the invention may be operated on a continuous or intermittent basis, and from time to time, components of the bath have to be replenished. The various components may be added singularly as requied or may be added in combination. The amounts of the various additive compositions to be added to the plating baths may be varied over a wide range depending on the nature and the performance of the plating bath to which the composition is added. Such amounts can be determined readily by one skilled in the art.

Another aspect of this invention relates to additive compositions which may be mixtures of the compositions of the invention without any solvent or carrier or they may be concentrates of the bath components in water, alcohols (e.g., propanol) or mixtures of water and one or more alcohols. The additive composition will comprise at least one of the novel compositions of the invention which are the reaction products described above, one or more of the desirable additional bath components and optionally diluent or solvent. The amounts of the compounds and the additive compositions or concentrates will be such that when they are diluted, they will provide the requisite amounts of the components of the bath or the requisite amounts of the components required to replenish the bath.

The following additive compositions or concentrates illustrate the various combinations of compounds that may be prepared and utilized in accordance with the invention for preparing and/or maintaining the baths of the invention, and/or improving the performance of the baths of the invention. Other additives may be added individually or in other combinations to the baths. In these additive examples, all amounts are parts by weight.

| Additive Composition 1 | Amount |
|---|---|
| Product of Example 1 | 8 |
| Surfonic N-150 | 4 |
| 1-Naphthaldehyde | 0.1 |
| 2,6-dichlorobenzene | 0.05 |
| Additive Composition 2 | |
| Product of Example 5 | 2 |
| Ethomeen C/15 | 15 |
| Additive Composition 3 | |
| Product of Example 4 | 10 |
| 4-methoxy naphthaldehyde | 0.1 |
| Amidox C-5 (ethoxylated alkylolamide from Stephen Chemical Co.) | 15 |
| 1,2,4-trichlorobenzene | 0.5 |
| Additive Composition 4 | |
| Product of Example 1 | 8 |
| Surfonic N-150 | 4 |
| Benzylidene acetone | 0.1 |

The embodiments of the invention in which an exclusive property or privilege is claimed are defined as follows:

1. A composition comprising the reaction product of at least one unsaturated nitrogen-containing heterocyclic compound with a mixture comprising formaldehyde and at least one unsaturated aliphatic aldehyde containing from three to about six carbon atoms.

2. The composition of claim 1 wherein the mole ratio of heterocyclic compound, formaldehyde and unsaturated aldehyde is from about 1:1:0.5 to about 1:4:2.

3. The composition of claim 1 wherein the mixture also contains at least one aliphatic carboxylic acid containing up to about five carbon atoms.

4. The composition of claim 3 wherein the carboxylic acid is formic acid or acetic acid.

5. The composition of claim 3 wherein the mole ratio of heterocyclic compound, formaldehyde, unsaturated aldehyde, and carboxylic acid is from about 1:1:0.5:0.5 to about 1:4:2:4.

6. The composition of claim 1 wherein the nitrogen-containing heterocyclic compound is an imidazole, a pyrazole, a pyrazine or a pyridine compound.

7. The composition of claim 6 wherein the nitrogen-containing heterocyclic compond is an imidazole compound.

8. The composition of claim 1 wherein the unsaturated aliphatic aldehyde is acrolein or crotonaldehyde.

9. An aqueous acidic plating bath for electrodeposition of tin, lead or tin-lead alloys comprising (A) at least one bath-soluble metal salt selected from the group consisting of a stannous salt, a lead salt, or a mixture of stannous and lead salts, and (B) as a brightener agent, an effective amount of at least one composition according to any of claims 1–8.

10. The plating bath of claim 9 wherein the bath comprises a mixture of stannous and lead ions and at least one radical selected from the group consisting of fluoborates, fluosilicates, sulfates, sulfamates or mixtures thereof.

11. The plating bath of claim 10 wherein the bath also contains (C) at least one carbonyl compound.

12. The plating bath of claim 11 wherein component C is an aliphatic aldehyde containing up to about four carbon atoms.

13. The plating bath of claim 12 wherein component C is acetaldehyde or formalin.

14. The plating bath of claim 11 wherein component C is an aromatic aldehyde or ketone.

15. The plating bath of claim 14 wherein component C is a naphthaldehyde.

16. The plating bath of claim 11 wherein the bath also contains (D) at least one aromatic amine.

17. The plating bath of claim 16 wherein component D is a halogen-containing aniline.

18. The plating bath of claim 11 wherein the bath also contains a nonionic or cationic wetting agent.

19. An aqueous acid plating bath for electrodeposition of a tin, lead or tin-lead alloy comprising from about 5 to about 350 grams per liter of (A) at least one metal ion selected from the group consisting of stannous ions, lead ions, and mixtures thereof, from about 50 to about 500 grams per liter of at least one radical selected from the group consisting of fluroborates, fluosilicates, sulfates, sulfamates, and mixtures thereof, and as a brightener, (B) about 1 to about 30 grams per liter of at least one composition according to any of claims 1–8, (C-1) from zero to about 10 grams per liter of at least one aromatic aldehyde, (C-2) from zero to about 25 grams per liter of an aliphatic aldehyde containing up to about four carbon atoms, (D) from zero to about 15 grams per liter of an aromatic amine, and (E) from zero to about 25 grams per liter of a nonionic or cationic wetting agent.

20. The method of electrodepositing a bright tin, lead or tin-lead alloy on a substrate which comprises electroplating said substrate in an aqueous acidic plating bath comprising (A) at least one metal ion selected from the group consisting of stannous ions, lead ions and mixtures thereof, and (B) as a brightener agent, an effective amount of at least one composition according to any of claims 1–8.

21. The method of claim 20 wherein the bath comprises a mixture of stannous and lead ions and at least one radical selected from the group consisting of fluoborates, fluosilicates, sulfates, sulfamates, and mixtures thereof.

22. The method of claim 21 wherein the bath also contains (C) at least one carbonyl compound.

23. The method of claim 22 wherein component C is an aliphatic aldehyde containing up to about four carbon atoms.

24. The method of claim 23 wherein component C is acetaldehyde or formalin.

25. The method of claim 22 wherein component C is an aromatic aldehyde or ketone.

26. The method of claim 25 wherein component C is a naphthaldehyde.

27. The method of claim 22 wherein the bath also contains (D) at least one aromatic amine.

28. The method of claim 27 wherein component D is a halogen-containing aniline.

29. The method of claim 21 wherein the bath also contains (E) a nonionic or cationic wetting agent.

30. A brightener additive composition for aqueous acid tin, lead or tin-lead electroplating baths comprising a mixture of (B) at least one composition according to any of claims 1–8, and (C) at least one aromatic aldehyde or ketone.

31. The additive composition of claim 30 wherein component C is a naphthaldehyde.

* * * * *